US005685142A

United States Patent [19]

Brewer et al.

[11] Patent Number: 5,685,142

[45] Date of Patent: Nov. 11, 1997

[54] GAS TURBINE ENGINE AFTERBURNER

[75] Inventors: Keith S. Brewer, North Palm Beach; Ronald T. Clawson; Steven B. Johnson, both of Stuart, all of Fla.

[73] Assignee: United Technologies Corporation, Hartford, Conn.

[21] Appl. No.: 632,381

[22] Filed: Apr. 10, 1996

[51] Int. Cl.[6] ..... F02R 3/10

[52] U.S. Cl. ..... 60/261; 60/39.821; 60/749

[58] Field of Search ..... 60/261, 739, 749, 60/39.821

[56] References Cited

U.S. PATENT DOCUMENTS

| | | | |
|---|---|---|---|
| 2,799,991 | 7/1957 | Conrad | 60/39.72 |
| 2,847,821 | 8/1958 | Brown | 60/39.821 |
| 2,946,185 | 7/1960 | Bayer | 60/35.6 |
| 2,948,117 | 8/1960 | Nerad et al. | 60/39.72 |
| 3,151,453 | 10/1964 | Lefebvre et al. | 60/261 |
| 3,800,527 | 4/1974 | Marshall et al. | 60/39.72 |
| 3,931,707 | 1/1976 | Vdoviak | 60/39.72 |
| 4,125,998 | 11/1978 | Barou et al. | 60/261 |
| 4,423,595 | 1/1984 | McLean | 60/261 |
| 4,765,136 | 8/1988 | Clements et al. | 60/261 |
| 4,815,283 | 3/1989 | Eldredge et al. | 60/261 |
| 5,179,832 | 1/1993 | Barcza et al. | 60/261 |
| 5,359,849 | 11/1994 | Auffret et al. | 60/261 |
| 5,367,873 | 11/1994 | Barcza et al. | 60/261 |

*Primary Examiner*—Charles G. Freay
*Attorney, Agent, or Firm*—Kenneth C. Baran

[57] ABSTRACT

An afterburner 20 for a gas turbine engine 10 has a fuel spray ring 24a for injecting fuel into the afterburner, a flameholder gutter 34a for stabilizing combustion of a fuel-air mixture flowing through the afterburner, and an ignitor 35 for initiating combustion and includes an enclosure 50 attached to the gutter. The enclosure has radially inner and outer walls 52, 54 and circumferentially spaced apart webs 60, 62 extending between the walls to define a radially and circumferentially bounded chamber 64. Each web has a forward opening 72 and an aft opening 74 so that a portion of the spray ring and a portion of the gutter are embraced by the enclosure. The enclosure is ideally circumferentially aligned with the ignitor and regulates the fuel-air ratio within and in the vicinity of the chamber to ensure reliable lighting of the afterburner and flawless advancement to full afterburning operation.

8 Claims, 4 Drawing Sheets

GAS TURBINE ENGINE AFTERBURNER

STATEMENT OF GOVERNMENT INTEREST

This invention was made under a U.S. Government contract and the Government has rights therein.

TECHNICAL FIELD

This invention relates to a gas turbine engine which has an afterburner with features for locally regulating the fuel-air ratio to ensure reliable ignition of the afterburner.

BACKGROUND OF THE INVENTION

Gas turbine engines for military fighter aircraft are often equipped with an afterburner for increasing the thrust output of the engine. An afterburner is a duct in the engine's exhaust system which acts as an auxiliary combustion chamber. The afterburner typically contains multiple fuel spray rings for introducing fuel into the afterburner, one or more electrically excited ignitors for initiating combustion, and a set of flameholder gutters for stabilizing the resultant flame. The energy which is released by combustion of fuel in the afterburner produces additional thrust as the combustion products are discharged through an exhaust nozzle. Afterburners consume a tremendous quantity of fuel and therefore are used sparingly. Typical uses include assisting an aircraft takeoff from a short airfield or carrier deck and providing additional speed for crucial combat maneuvers. Accordingly, afterburners must ignite reliably.

During nonafterburning operation of an engine, a mixture of air and atomized fuel is burned in the engine's main combustion chamber. The fuel-air ratio in the main combustion chamber is leaner than the stoichiometric fuel-air ratio so that the products of the combustion reaction contain little or no unburned fuel, but a significant quantity of unreacted air. These combustion products flow through the afterburner and are expanded through a variable area exhaust nozzle to produce thrust. Typically, the variable area nozzle is at its minimum area position during nonafterburning operation.

The transition from nonafterburning operation to afterburning operation is referred to as lighting the afterburner and is accomplished by energizing the ignitors while introducing fuel into the afterburner through one of the fuel spray rings, referred to as the pilot ring. The ignitors initiate combustion of the fuel, the combustion being supported by the unreacted air in the combustion products from the main combustion chamber. The resulting flame is stabilized and held in place by one of the flameholder gutters, known as the pilot gutter. Once this initial or pilot stage of afterburning is established, additional fuel is supplied, usually sequentially, to each of the remaining or auxiliary spray rings until all the spray rings are injecting fuel into the afterburner. The pilot flame ignites the additional fuel and the flame expands from the pilot gutter to a series of auxiliary gutters to achieve full afterburning operation. Meanwhile, the variable area nozzle opens wider to provide additional flow area for discharging the hot gasses. The provision of fuel to the various spray rings, the opening of the variable area exhaust nozzle and the operation of the ignitors is overseen and coordinated by an automatic control system operating in response to the position of a throttle lever set by the pilot of the aircraft. The time required for the above described lighting process is on the order of a few seconds.

One potential problem with an afterburner is that at some flight conditions its pilot stage may not light due to an excessively lean fuel-air ratio in the vicinity of the ignitors. A second problem is that the time in an operating pilot stage may blow out when the aircraft fuel system supplies fuel to the auxiliary spray rings. This latter problem occurs because the fuel pressure in the pilot spray ring momentarily diminishes as the aircraft fuel system initially attempts to supply both the pilot spray ring and the auxiliary spray rings. As a result the fuel-air ratio becomes too lean to sustain combustion of the pilot flame. Since afterburners are used in critical combat situations, any such failure to light or any failure to advance to full afterburning operation is unacceptable.

The above described problems might be solved by extensive modifications to the hardware of the afterburner or the fuel delivery system. It may also be possible to implement sophisticated control strategies to compensate for fuel mixture derichment. These approaches, however, are likely to introduce additional weight, cost or complexity, all of which are undesirable in an aircraft and particularly in a military fighter aircraft.

What is needed is an afterburner which lights reliably, advances flawlessly to full afterburning operation, and does not introduce significant weight, cost or complexity.

DISCLOSURE OF THE INVENTION

It is therefore an object of the present invention to ensure reliable lighting of the pilot stage of an afterburner under all flight conditions.

It is a second object of the invention to ensure that pilot stage combustion is sustained so that the afterburner reliably advances to full afterburning operation.

It is a third object of the invention to achieve the first and second objects without significantly affecting the weight, cost or complexity of the afterburner or its associated control and fuel supply systems.

According to the invention a gas turbine engine afterburner includes one or more enclosures each of which defines a radially and circumferentially bounded chamber for controlling the fuel-air ratio within and in the vicinity of the chamber.

Ideally, each enclosure embraces portions of both a fuel spray ring and a flameholder gutter and is circumferentially aligned with an ignitor so that the fuel-air ratio in the vicinity of the ignitor is sufficiently rich to ensure reliable ignition of the pilot stage and flawless advancement to full afterburning operation.

In one detailed embodiment, radially inner and outer walls and a pair of circumferentially spaced apart webs extending between the walls cooperate to form a box-like enclosure with a longitudinally extending flowpath therethrough. The inner and outer walls are attached to a flameholder gutter and the aft end of each web has an opening so that the enclosure embraces a portion of the gutter. A fuel spray ring extends through similar openings in the forward ends of the webs so that the enclosure embraces a portion of the spray ring.

BEST MODE FOR CARRYING OUT THE INVENTION

Figure 1:
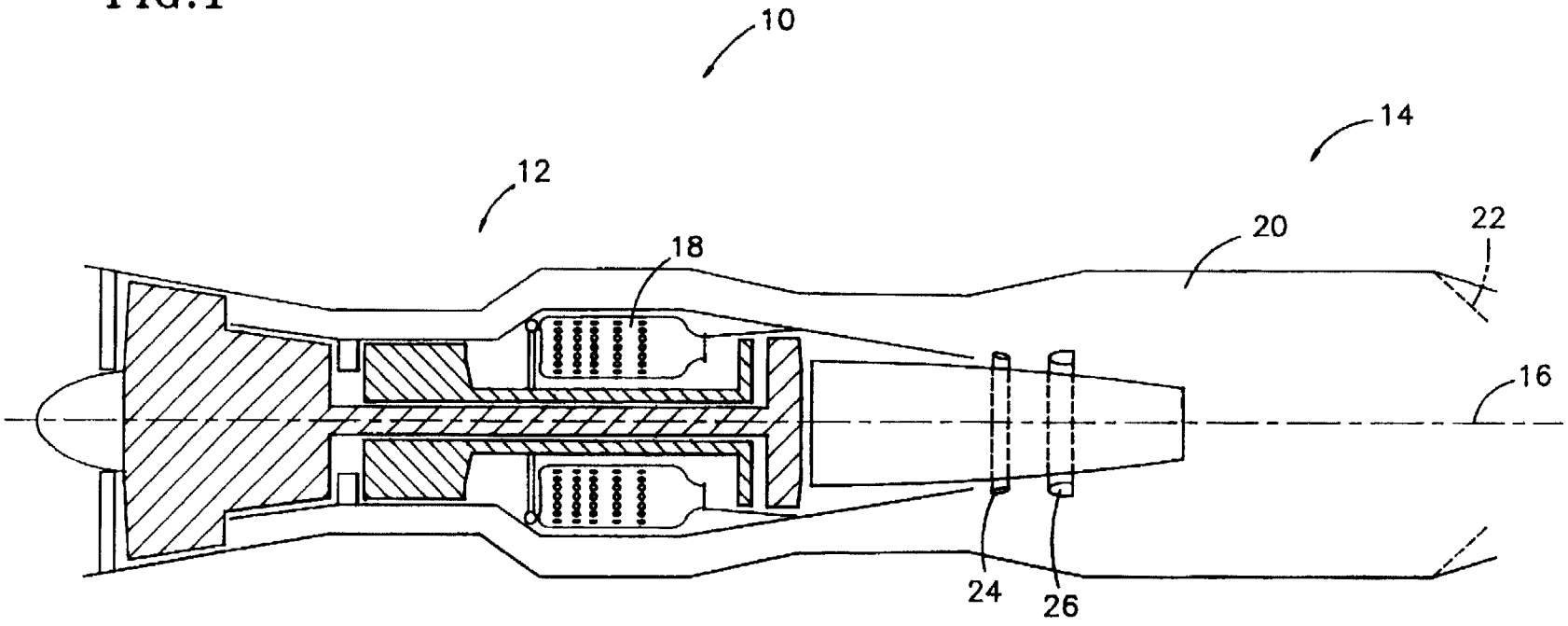
FIG. 1 is a schematic cross sectional side view of an afterburner equipped gas turbine engine.

FIG. 1 illustrates a military aircraft gas turbine engine 10 which includes a gas generator section 12 and an exhaust system 14 disposed about a longitudinally extending central axis 16. The gas generator includes a main combustion chamber 18 and the exhaust system includes an afterburner 20 and a variable area exhaust nozzle 22. The afterburner includes one or more fuel spray rings and a system of flameholder gutters as illustrated by representative spray ring 24 and gutter 26. The construction and operation of such engines are well known and need not be described in detail here. It is sufficient to appreciate that atomized fuel is ignited and burned in the main combustion chamber 18. The products of combustion (which are frequently referred to as air since they contain a significant quantity of unreacted oxygen) flow in the downstream direction through the afterburner 20 and are discharged through the exhaust nozzle 22. During nonafterburning operation, the afterburner merely serves as a conduit between the gas generator 12 and the exhaust nozzle 22. During afterburning operation, additional fuel is introduced into the afterburner where it is ignited and burned, the combustion being supported by the unreacted oxygen in the combustion products from the main combustion chamber. The additional fuel represents additional energy which is converted to additional thrust as the hot gasses expand through the exhaust nozzle.

Figure 2:
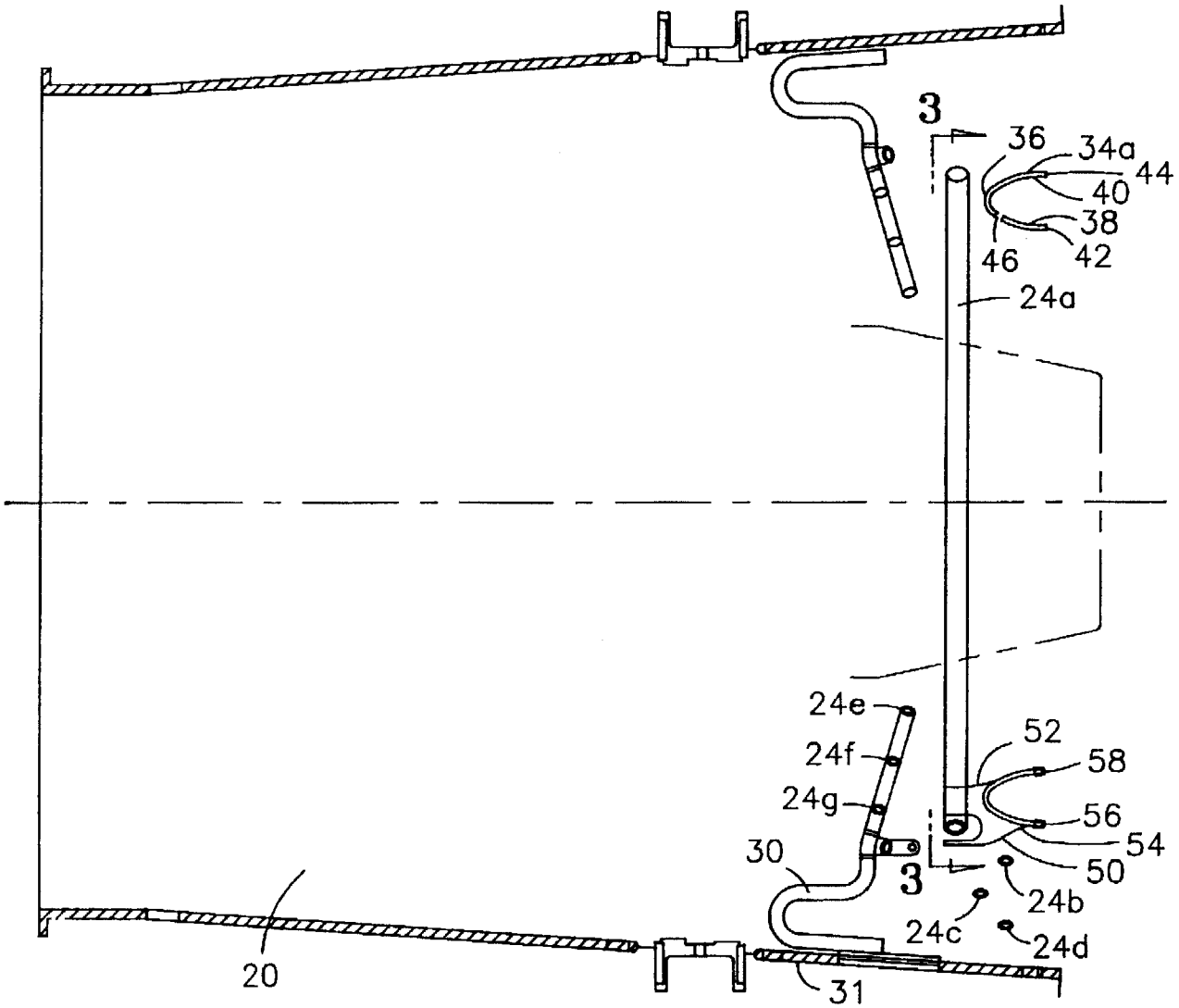
FIG. 2 is a cross sectional side view of the afterburner of a gas turbine engine showing an enclosure according to the present invention attached to a flameholder gutter.
Figure 3:
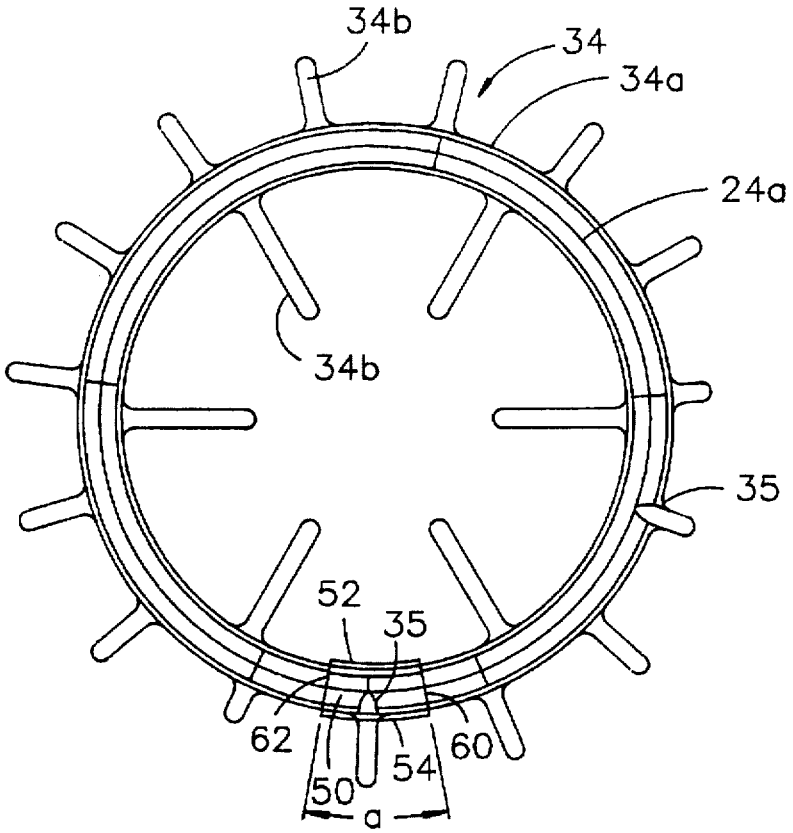
FIG. 3 is a sectional view taken essentially along the line 3—3 of FIG. 2 showing the enclosure according to the invention attached to a flameholder gutter.

Further details of the construction and operation of the afterburner are appreciated by reference to FIGS. 2 and 3. The afterburner includes a pilot fuel spray ring **24*a* and several auxiliary spray rings 24*b* through 24*g*. Fuel delivery conduits such as conduit 30 support the spray rings from afterburner duct wall 31 and provide a means for supplying fuel to the spray rings (the conduits associated with spray rings 24*a* through 24*d* are not in the plane of the illustration and therefore are not visible). Each spray ring includes a series of circumferentially spaced orifices 32 (visible in FIG. 4) through which fuel is injected into the afterburner. Most of the orifices in the pilot ring 24*a*** are variable area orifices. A pintle valve, not shown, is associated with each variable orifice. Each pintle valve regulates the flow area of a variable orifice between a minimum area when the pilot stage of afterburning is initially engaged and a maximum area when the pilot stage is operating at its maximum capacity. The remaining orifices are fixed, constant area orifices. The area of a fixed orifice is larger than the maximum area of a variable orifice. As a result the fuel-air ratio (the ratio of the mass flow rate of fuel to the mass flow rate of air) and the equivalence ratio (the ratio of fuel-air ratio to stoichiometric fuel air ratio) downstream of the fixed orifices is normally richer than the fuel-air ratio elsewhere around the circumference of the afterburner.

The afterburner also includes one or more electrically excited ignitors 35 for igniting the fuel introduced into the afterburner through the spray rings and a system of U-shaped flameholder gutters 34 for stabilizing the resultant flame. The flameholder gutter system includes a circumferentially extending pilot gutter **34*a* immediately downstream of the pilot spray ring and a series of auxiliary gutters 34*b* extending radially inward and outward from the pilot gutter. Each gutter has an apex 36 at its forward or upstream end. Gutter legs, such as inner and outer gutter legs 38, 40 of the pilot gutter, diverge from and extend longitudinally downstream from the apex. Each leg terminates at a trailing edge 42, 44. Slots 46 spaced circumferentially around the pilot gutter admit a mixture of air and atomized fuel into the interior of the gutter. The ignitors 35** extend into the interior of the gutters and are circumferentially aligned with the fixed orifices in the pilot spray ring. This circumferential alignment facilitates lighting of the pilot stage by ensuring that the fuel-air ratio in the vicinity of the ignitors is richer than the fuel-air ratio elsewhere around the circumference of the afterburner.

When the pilot of an aircraft demands afterburning operation by setting the aircraft throttle lever to the appropriate position, the afterburner ignitors are energized and fuel is injected radially inward into the afterburner through the pilot ring orifices 32 and is atomized by the combustion products flowing through the afterburner. The fuel-air mixture enters the pilot gutter **34*a* through slots 46. The ignitors ignite the fuel and the resultant flame spreads circumferentially around the pilot gutter and is held in place by the pilot gutter. Once this pilot stage is operating, full afterburning operation is achieved by supplying fuel, usually sequentially, to the auxiliary spray rings 24*b* through 24*g* until all of the auxiliary rings are injecting fuel into the engine. The fuel is atomized by the combustion products flowing through the afterburner and the fuel-air mixture is ignited by the existing pilot flame. The radially extending auxiliary gutters 34*b* cooperate with the pilot gutter 34*a*** to stabilize the now expanded flame front. Once full afterburning operation is established, the ignitors are de-energized to maximize their useful life.

Despite the circumferential alignment of the fixed orifices with the ignitors, the fuel-air ratio in the vicinity of the ignitors may be too lean to ensure reliable afterburner lighting. This is especially true at high altitude and low airspeed. Even if the pilot stage lights successfully, the attempt to advance to full afterburning operation causes a momentary decrease in the pilot spray ring fuel pressure with an accompanying derichment of the fuel mixture. As a consequence the pilot stage may blow out so that the engine's thrust fails to increase as desired. Since afterburning operation is often used in crucial situations, the inability of the afterburner to light and advance to full afterburning operation is unacceptable.

According to the present invention, an afterburner includes an enclosure defining a radially and circumferentially bounded chamber which embraces a portion of the pilot spray ring and a portion of the pilot gutter so that the fuel-air ratio within and in the vicinity of the chamber is maintained within a range that ensures reliable afterburning lighting and flawless advancement to full afterburning operation.

Referring now to FIGS. 2 through 5 (and primarily to FIGS. 4 and 5) an enclosure 50 has radially inner and outer walls 52, 54 each having a trailing edge, 56, 58 respectively. A pair of circumferentially spaced apart webs 60, 62 extends between and connects the walls so that the enclosure defines a radially and circumferentially bounded chamber 64 having an intake 66. The enclosure is positively attached to the pilot gutter **34*a* by rivets 70 so that there is no relative movement between the enclosure and the gutter as they expand and contract due to temperature variations. The forward and aft ends of each web have forward and aft openings 72, 74 so that when the enclosure is attached to the gutter, the gutter passes through the aft openings and the enclosure embraces a circumferentially limited portion of the gutter. Similarly, the pilot spray ring 24a passes through the forward openings so that the enclosure embraces a circumferentially limited portion of the spray ring. An outlet 76 of the enclosure is defined by a space 78 between the inner wall 52 and the gutter inner leg 38 and by another space 80 between the outer wall 54 and the gutter outer leg 40. A flowpath 82 extends longitudinally through the enclosure from the intake to the outlet. Ideally, the enclosure is circumferentially aligned with an ignitor. An aperture 84 in the radially outer wall 54 accommodates the presence of the ignitor and, as best seen in FIG. 3**, a radially extending auxiliary gutter.

Figure 4:
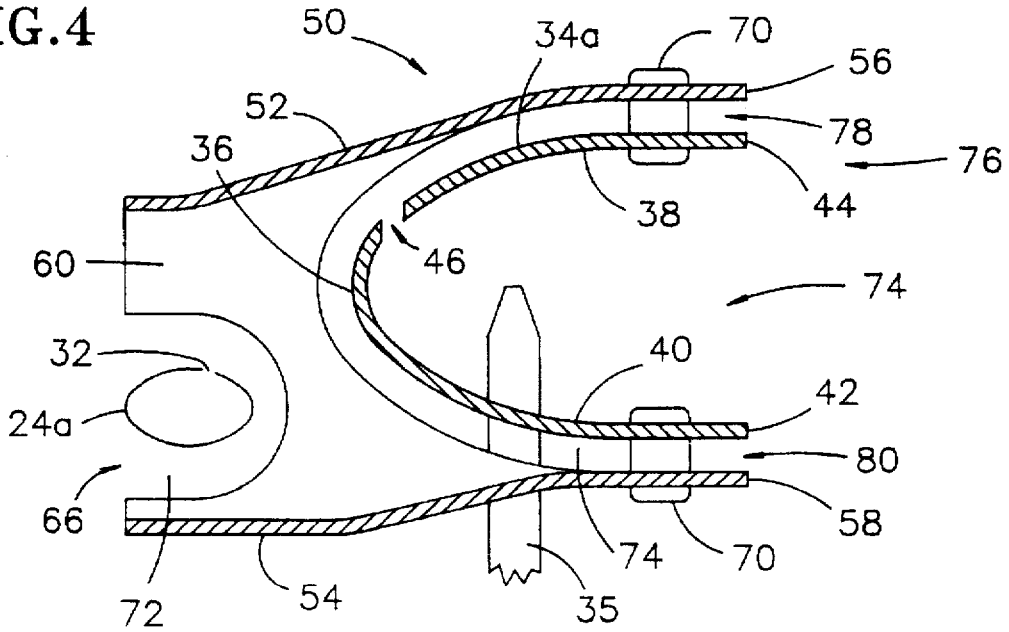
FIG. 4 is a cross sectional side view of the enclosure of the invention attached to a flameholder gutter.
Figure 5:
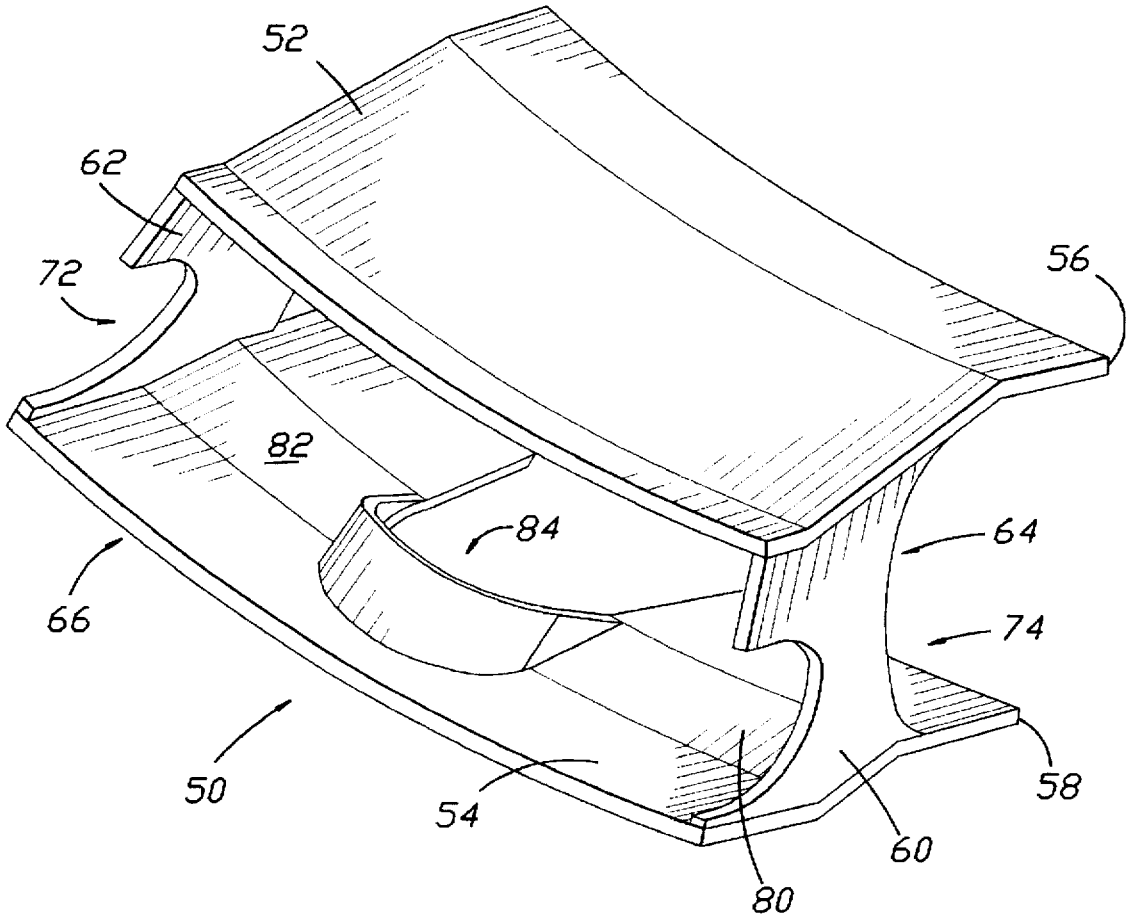
FIG. 5 is a perspective view of the enclosure of the invention.

When the enclosure is attached to the pilot gutter as illustrated in FIG. 4, the trailing edges 56, 58 of the inner and outer enclosure walls are no further downstream than the trailing edges 42, 44 of the gutter legs. This ensures that the afterburner flame, which originates in the interior of the flameholder gutter and extends downstream of the gutter legs, does not burn the enclosure walls thereby reducing the enclosure's useful life.

In operation, the inner wall 52 of the enclosure captures fuel injected through the orifices 32 in the pilot spray ring 24a. The inner and outer walls 52, 54 cooperate with the webs 60, 62 to admit a regulated quantity of combustion products (i.e. air) through the enclosure intake 66 and into the chamber 64. The resulting fuel-air mixture flows longitudinally through the chamber, the flow rate of the mixture being throttled by outlet spaces 78 80, and a portion of the mixture enters the pilot gutter 34a through slots 46. The mixture in the interior of the gutter is ignited by the ignitors and the ensuing flame ignites the mixture flowing out of spaces 78, 80 while rapidly propagating around the circumference of the gutter. With the pilot stage of afterburning thus established, additional fuel is injected through the auxiliary spray rings, as described previously, to advance to full afterburning operation.

By capturing the fuel injected by the spray rings and regulating the quantity of combustion products into the chamber, the enclosure establishes a circumferentially localized fuel-air ratio that is sufficiently rich to ensure successful pilot stage lighting even under adverse conditions of low airspeed at high altitude. Moreover, the fuel-air ratio remains high enough to preclude afterburner blowout due to any transient decrease in pilot spray ring fuel pressure associated with the advancement to full afterburning operation.

While it is important to maintain a sufficiently rich fuel-air ratio (or equivalence ratio) in the local vicinity of the ignitors, excessive local enrichment is undesirable. Excessive local enrichment causes excessive temperatures in the afterburner and contributes to a circumferentially nonuniform temperature distribution and concomitant thermal stresses. For the gas turbine engine in which the first use of the invention is envisioned, the equivalence ratio within and in the vicinity of the chamber is ideally in the range of 1.0 to 3.0 and most preferably in the range of 1.0 to 1.5. The equivalence ratio is maintained within these limits in part by limiting the circumferential extent $\alpha$ (FIG. 3) of the enclosure to between 20 and 30 degrees.

The advantages of the invention include its light weight, low cost and minimal complexity of the enclosure—features which are especially important in aircraft. Moreover, since the chamber is circumferentially bounded rather than circumferentially continuous, it is unaffected by the thermal stresses which would be imposed on a circumferentially continuous part.

We claim:

1. An afterburner for a gas turbine engine having a fuel spray ring for injecting fuel into the afterburner, a flameholder gutter for stabilizing combustion of a fuel-air mixture flowing longitudinally through the afterburner, and an ignitor for initiating combustion, the afterburner characterized by an enclosure defining a radially and circumferentially bounded chamber, the enclosure embracing a portion of the spray ring and a portion of the gutter for controlling the fuel-air ratio within and in the vicinity of the chamber.

2. The afterburner of claim 1 further characterized in that the enclosure comprises walls each having a trailing edge and the gutter includes legs extending downstream from an apex, each leg also having a trailing edge and the trailing edges of the walls are no further downstream than the trailing edges of the legs so that a flame extending downstream of the trailing edges of the gutter does not burn the enclosure walls.

3. The afterburner of claim 1 further characterized in that the enclosure extends circumferentially at least 20 degrees and no more than 30 degrees.

4. The afterburner of claim 1 further characterized in that the equivalence ratio within and in the vicinity of the chamber is in the range of approximately 1.0 to 3.0 and most preferably.

5. The afterburner of claim 1 further characterized in that the enclosure is positively attached to the gutter.

6. The afterburner of claim 1 further characterized in that the ignitor is circumferentially aligned with the chamber and extends into the interior of the gutter.

7. The afterburner of claim 4 further characterized in that the equivalence ratio within the vicinity of the chamber is in the range of 1.0 to 1.5.

8. An afterburner for a gas turbine engine having a fuel spray ring for injecting fuel into the afterburner, a flameholder gutter for stabilizing combustion of a fuel-air mixture flowing longitudinally through the afterburner, and an ignitor for initiating combustion, the afterburner characterized by an enclosure attached to the gutter, the enclosure having radially inner and outer walls and circumferentially spaced apart webs extending between the walls, the walls and webs defining a radially and circumferentially bounded chamber with a longitudinally extending flowpath therethrough, each web having a forward opening and an act opening so that a portion of the spray ring and a portion of the gutter are embraced by the enclosure and the fuel-air ratio within and in the vicinity of the chamber is maintained within a desirable range.

* * * * *